United States Patent [19]

Ballestrazzi et al.

[11] Patent Number: 4,693,053

[45] Date of Patent: Sep. 15, 1987

[54] DEVICE FOR CONTROLLING THE UNWINDING OF A PLASTICS FILM IN A PACKAGING MACHINE

[75] Inventors: Aris Ballestrazzi; Lamberto Tassi, both of Savignano sul Panaro, Italy

[73] Assignee: SITMA Societa Italiana Macchine Automatiche S.p.A., Spilamberto, Italy

[21] Appl. No.: 875,537

[22] Filed: Jun. 18, 1986

[30] Foreign Application Priority Data

Jun. 26, 1985 [IT] Italy ..... 22272/85[U]

[51] Int. Cl.[4] ..... B65B 41/12

[52] U.S. Cl. ..... 53/389; 53/64; 83/236

[58] Field of Search ..... 83/236; 53/389, 64, 53/203

[56] References Cited

U.S. PATENT DOCUMENTS

| | | | |
|---|---|---|---|
| 2,636,731 | 4/1953 | Howard | 53/389 X |
| 2,718,738 | 9/1955 | Mast et al. | 53/389 X |
| 2,813,798 | 11/1957 | Toby | 53/389 X |
| 3,084,491 | 4/1963 | Solomon | 53/389 |
| 3,504,586 | 4/1970 | Acquaviva, Jr. | 83/236 X |

*Primary Examiner*—James F. Coan

*Attorney, Agent, or Firm*—Fleit, Jacobson, Cohn & Price

[57] ABSTRACT

The invention relates to a device for controlling the unwinding of a plastic film in a packaging machine. The film before coming in contact with a conveyor belt for the products to be packaged passes in succession through a pair of dragging rollers and about a floating bar disposed between fixed guide rollers. The drive roller of the pair of rollers is driven by a variable speed motor by way of two alternately activated transmission of different ratio. Two microswitches disposed at different levels cooperate with the floating bar in order to activate one or the other of the transmissions.

2 Claims, 2 Drawing Figures

DEVICE FOR CONTROLLING THE UNWINDING OF A PLASTICS FILM IN A PACKAGING MACHINE

This invention relates to a device for controlling the unwinding of a plastics film in a packaging machine.

In packaging machines, it is known to use plastics film in which the products to be packaged are wrapped and which are unwound from suitable reels. The film unwound from the reel is guided on to a conveyor belt for the products to be packaged, is wrapped about the products by suitable means, and is then welded and cut transversely in the gap between two successive products in order to form the individual packs. Normallyh the dragging force for unwinding the film from the reel is provided directly by the product conveyor belt on to which the film is guided, and with which it has to move exactly at the same linear speed.

Now during the packaging, the plastics film undergoes deformation which because of its elasticity is of a greater or lesser extent depending on the instantaneous packaging speed and the outer diameter of the reel from which it unwinds. This deformation is greater the smaller the film thickness, and the variation in the deformation increases with the reel diameter. Again, in order to save packaging film and to attain improved self-sufficiency, the tendency is to use increasingly thinner film and reels of increasingly larger diameter.

The aforesaid drawbacks are particularly serious when film is used which is preprinted or carries signs or reference marks which is the finished packs have to be perfectly centered with respect to the product. In this respect, it is apparent that any film deformation affects the distance between said signs, reference marks or the like, with the result that this distance no longer corresponds to the predetermined product pitch during packaging, leading to undesirable off-centering of said signs with respect to the product.

It is therefore apparent that to obtain correct operation of the packaging machine, independently of the packaging speed, the film thickness, the diameter of the reel from which the film is unwound or other factors, it is of maximum important to ensure that the linear speed of advancement of the film and of the conveyor belt for the products to be packaged are exactly equal along the packaging line.

The object of the present invention is precisely to create a control device which ensures that these speeds are equal. This object is attained according to the invention by a device for controlling the unwinding of a plastics film from a reel in a packaging machine comprising a conveyor belt for the products to be packaged and a variable speed motor for driving said conveyor belt by means of a drive roller, the device being characterized in that said film, between the point at which it unwinds from the reel and the point at which it makes contact with said conveyor belt, passes in succession at least through a pair of dragging rollers and about a floating cylindrical bar disposed between two fixed film guide rollers, and in that the drive roller of said pair of dragging rollers receives its motion from the conveyor belt drive roller, driven by said variable speed motor, by way of a linkage comprising two alternately activated transmission of different ratios, one ratio being such that the linear film unwinding speed induced by said pair of dragging rollers is slightly less than the linear speed of advancement of the conveyor belt, the other ratio being such that the linear film unwinding speed is slightly greater than the linear speed of said belt, said floating bar cooperating with two microswitches which are vertically superposed at two different levels and arranged to activate respectively one and the other of said transmissions when the floating bar reaches the levels of the relative microswitches during its vertical reciprocating motion.

By means of this device, that film portion downstream of the floating bar remains subjected only to a constant force determined by the actual weight of the said floating bar, independently of any other upstream influence, such as the reel diameter, instantaneous film unwinding speed etc., so that said downstream portion moves reliably with the same linear speed as the conveyor belt for the products to be packaged, and no relative sliding or movement between said products and the film can take place. That film portion upstream of the floating bar is fed by the pair of dragging rollers at a speed which is temporarily slightly less than and, respectively, temporarily slightly greater than the linear speed of advancement of the conveyor belt. While the feed speed is less than the speed of advancement of the belt (equal to the linear speed of that film portion downstream of the floating bar) the floating bar means upwards to shorten the film loop formed between the two fixed guide rollers, whereas while the film feed speed is greater than the speed of advancement of the belt said loop lenghtens and the floating bar moves downwards. When the floating bar reaches the level of one or the other of the two microswitches, these are operated to deactivate that transmission which was active up to that moment, and activate the other transmission, thus changing the transmission ratio between the drive roller controlling the advancement of the conveyor belt and the drive roller of the pair of dragging rollers which unwind the film from the reel.

Advantgeously, the floating bar is guided in its vertical reciprocating movement, and can also carry close to its two ends pinions which engage in respective fixed vertical racks, so as to convert the vertical motion of the floating bar into combined rectilinear motion and rotary motion about its axis, to substantially eliminate any friction between the floating bar and the film during unwinding.

The characteristics and advantages of the device according to the invention will be more apparent from the description given hereinafter with reference to the accompanying drawing, which diagrammatically illustrates one embodimenmt of said device.

In particular,

Figure 1:
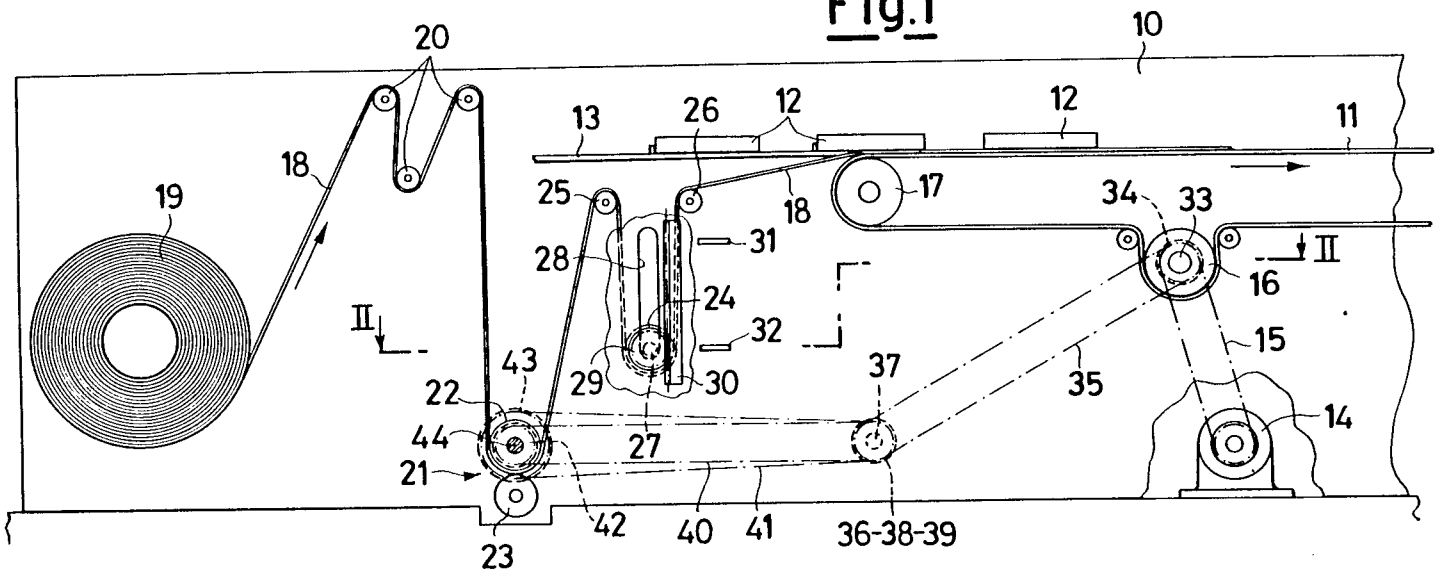
FIG. 1 is a diagrammatic side view of the device.
Figure 2:
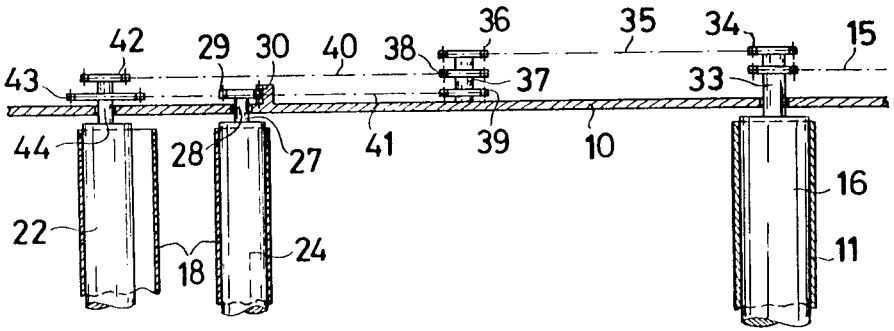
FIG. 2 is a partly sectional plan view on the line II—II of FIG. 1.

In the drawings, the reference numeral 10 diagrammatically indicates a side wall of the packaging machine frame. This machine comprises a conveyor belt 11 for the products 12 to be packaged, these products being fed on to the belt 11 by a thrust peg conveyor, which is indicated only diagrammatically at 13. By way of a chain transmission 15, a variable speed motor 14 operates a drive roller 16 about which the conveyor belt 11 is guided and is driven thereby. The forward movement of the belt 11 is continuous, but is variable by means of the variable speed motor 14, the belt 11 being guided about a deviation roller 17 in correspondence with the point at which the products 12 arrive from the conveyor 13.

A plastics film 18 originating from a reel 19 is guided towards the deviation roller 17 of the belt 11. Starting from the reel 19, the film 18 passes firstly about deviation rollers 20, then through a pair of dragging rollers 21, of which the roller 22 is the drive roller and the roller 23 is the pressure roller, and then about a floating cylindrical bar 24 disposed between two guide rollers 25, 26, to finally reach the deviation roller 17 of the belt 11.

The shaft 27 of the floating bar 24 passes through a vertical guide slot 28 provided in the side wall 10, so that the bar is compelled to move vertically. Moreover, at its end (of which only one is visible) the shaft 27 carries pinions 29 which engage with fixed vertical racks 30, so as to cause the shaft 27 and the floating bar 24 to rotate about their axis when the bar moves vertically. One end of the shaft 27 cooperates with two microswitches 31 and 32, for example of magnetic type, which are disposed one vertically above the other at two predetermined levels, their purpose being described hereinafter.

The following linkage is provided for rotating the drive roller 22 of the pair of dragging rollers 21 for the film 18. On the shaft 33 of the conveyor belt 11 drive roller 16, which is rotated by the variable speed motor 14 by way of the chain transmission 15, there is mounted a sprocket wheel 34 which transmits motion, by way of a chain 35, to a sprocket wheel 36 fixed on an intermediate shaft 37. The transmission ratio between the shafts 33 and 37 is 1:1. The shaft 37 also carries two sprocket wheels 38 and 39 which can be alternately connected rigidly to said shaft by electromagnetic clutches, not shown. Two toothed wheels 42, 43 of different diameters (and different numbers of teeth) are fixed on to the shaft 44 of the drive roller 22 of the pair of dragging rollers 21, said toothed wheels being connected to the sprocket wheels 38 and 39 respectively by means of respective chains 40 and 41. Between the shafts 37 and 44 there are thus two transmissions of different ratios which can be activated alternately by rigidly connecting in one case the sprocket wheel 38, and in the other case the sprocket wheel 39 to the intermediate shaft 37 by means of the respective electromagnetic clutches. The two transmission ratios are chosen such that when one is active (transmission from the sprocket wheel 38 to the toothed wheel 42 by way of the chain 40) the speed at which the film 18 unwinds from the reel 19 is slightly greater than the linear speed of advancement of the conveyor belt 11, whereas when the other is active (transmission from the sprocket wheel 39 to the toothed wheel 43 by way of the chain 41) the speed at which the film 18 unwinds is slightly less than the speed of advancement of the belt 11. The electromagnetic clutch which connects the sprocket wheel 38 to the shaft 37 is activated by the microswitch 31 when the floating bar 24 reaches its upper predetermined level, whereas the electromagnetic clutch which connects the sprocket wheel 39 to the shaft 37 is activated by the microswitch 32 when the floating bar 24 reaches its lower predetermined level.

In this manner, the floating bar 24 continuously undergoes vertical reciprocating motion (in addition to rotating about its axis by virtue of the engagement of the pinions 29 in the racks 30), and the loop of film 18 f ormed between the deviation rollers 25 and 26 continuously lenghtens or shortens.

As far as the point at which it makes contact with the conveyor belt 11 in corresponds with the deviation roller 17, the film portion 18 downstream of the floating bar 24 is subjected only to a constant traction force determined by the actual weight of the floating bar, and is not influenced either by the varying diameter of the reel 19 from which the film unwinds, or by the instantaneous packaging speed (corresponding to the linear speed of advancement of the conveyor belt 11 for the products 12 to be packaged).

In this manner the damaging variable deformation of the plastics film is obviated, and the speed of advancement of the film and the speed of advancement of the products along the packaging line are guaranteed equal.

We claim:

1. A device for controlling the unwinding of a plastics film from a reel in a packaging machine comprising a conveyor belt for the products to be packaged and a variable speed motor for driving said conveyor belt by means of a drive roller, characterised in that said film, between the point at which it unwinds from the reel and the point at which it makes contact with said conveyor belt, passes in succession at least through a pair of dragging rollers and about a floating cylindrical bar disposed between two fixed film guide rollers, and in that the drive roller of said pair of dragging rollers receives its motion from the conveyor belt drive roller, driven by said variable speed motor, by way of a linkage comprising two alternately activated transmissions of different ratios, one ratio being such that the linear film unwinding speed induced by said pair of dragging rollers is slightly less than the linear speed of advancement of the conveyor belt, the other ratio being such that the linear film unwinding speed is slightly greater than the linear speed of said belt, said floating bar cooperating with twol microswitches which are vertically superposed at two different levels and arranged to activate respectively one and the other of said transmissions when the floating bar reaches the levels of the relative microswitches during its vertical reciprocating motion.

2. A device as claimed in claim 1, characterised in that, in correspondence with its ends, the floating bar is guided in vertical guide slots and carries pinions which engages in respective fixed vertical racks.

* * * * *